US010301819B2

(12) United States Patent
Schmitz et al.

(10) Patent No.: US 10,301,819 B2
(45) Date of Patent: May 28, 2019

(54) WALL ELEMENT

(71) Applicants: Burkhard Schmitz, Berlin (DE); Carola Zwick, Berlin (DE); Roland Zwick, Berlin (DE)

(72) Inventors: Burkhard Schmitz, Berlin (DE); Carola Zwick, Berlin (DE); Roland Zwick, Berlin (DE)

( * ) Notice: Subject to any disclaimer, the term of this patent is extended or adjusted under 35 U.S.C. 154(b) by 366 days.

(21) Appl. No.: 15/175,686

(22) Filed: Jun. 7, 2016

(65) Prior Publication Data

US 2016/0289955 A1 Oct. 6, 2016

Related U.S. Application Data

(63) Continuation of application No. PCT/EP2014/074305, filed on Nov. 12, 2014.

(30) Foreign Application Priority Data

Dec. 11, 2013 (DE) ..... 10 2013 020 505
Mar. 18, 2014 (DE) ..... 10 2014 003 725

(51) Int. Cl.
*E04B 1/62* (2006.01)
*E04B 1/84* (2006.01)
*E04B 1/86* (2006.01)

(52) U.S. Cl.
CPC ..... *E04B 1/8409* (2013.01); *E04B 1/62* (2013.01); *E04B 1/86* (2013.01);
(Continued)

(58) Field of Classification Search
CPC ..... E04B 1/62; E04B 1/86; E04B 2001/8423; E04B 2001/8414; E04B 2001/8428; E04B 2001/8471
(Continued)

(56) References Cited

U.S. PATENT DOCUMENTS 5,057,176 A * 10/1991 Bainbridge ..... B31F 1/0009 156/222
6,186,270 B1 * 2/2001 Roller ..... G10K 11/168 181/286
(Continued)

FOREIGN PATENT DOCUMENTS

CN 2259449 Y 8/1997
CN 2576836 Y 10/2003
(Continued)

OTHER PUBLICATIONS

Chinese Office Action (Application No. 201480066929.2) dated Jul. 7, 2017 (with English translation).
(Continued)

*Primary Examiner* — Forrest M Phillips
(74) *Attorney, Agent, or Firm* — Burr & Brown, PLLC

(57) ABSTRACT

The invention concerns a wall element including a felt panel that has at least two felt layers, with at least one felt layer having a three-dimensional structure on at least one top side. The felt panel includes as its top layer a plane felt layer, as its bottom layer a plane felt layer, and as its middle layer at least one corrugated felt layer. The corrugated felt layer bordering on the top layer is connected to the top layer on its top side in the region of upper vertex lines or vertex points formed by its wave peaks. The corrugated felt layer bordering on the bottom layer is connected to the bottom layer on its bottom side in the region of lower vertex lines or vertex points formed by its wave valleys.

27 Claims, 21 Drawing Sheets

(52) U.S. Cl.
CPC ..... *E04B 2001/8414* (2013.01); *E04B 2001/8423* (2013.01); *E04B 2001/8428* (2013.01); *E04B 2001/8471* (2013.01)

(58) Field of Classification Search
USPC ..... 181/290, 292, 284
See application file for complete search history.

(56) References Cited

U.S. PATENT DOCUMENTS

| | | | | |
|---|---|---|---|---|
| 6,821,607 | B2 * | 11/2004 | Zwick | B32B 3/28 181/290 |
| 2009/0250291 | A1 * | 10/2009 | Sparks | E04B 1/86 181/290 |
| 2013/0206501 | A1 * | 8/2013 | Yu | E04B 9/045 181/290 |
| 2014/0202788 | A1 * | 7/2014 | Hansen | E04B 1/84 181/290 |
| 2015/0292200 | A1 * | 10/2015 | More | H02K 5/24 181/284 |
| 2016/0024783 | A1 * | 1/2016 | Luhtala | E04B 1/84 181/290 |

FOREIGN PATENT DOCUMENTS

| | | | |
|---|---|---|---|
| CN | 2718106 | Y | 8/2005 |
| CN | 201043324 | Y | 4/2008 |
| CN | 103290985 | A | 9/2013 |
| EP | 2 410 099 | A2 | 1/2012 |
| JP | H01-270544 | A1 | 10/1989 |
| JP | H07-009599 | A1 | 1/1995 |
| JP | 10-072883 | A | 3/1998 |
| JP | 2005-114028 | A1 | 4/2005 |

OTHER PUBLICATIONS

English translation of International Preliminary Report on Patentability (Chapter I) (Application No. PCT/EP2014/074305) dated Jun. 23, 2016.

International Search Report (With English Translation) and Written Opinion, International Application No. PCT/EP2014/074305, dated Jan. 22, 2015 (11 pages).

* cited by examiner

WALL ELEMENT

CROSS REFERENCE TO RELATED APPLICATIONS

This application is a continuation of International Application No. PCT/EP2014/074305 filed Nov. 12, 2014, which designated the United States, and claims the benefit under 35 USC § 119(a)-(d) of German Application No. 10 2013 020 505.0 filed Dec. 11, 2013 and German Application No. 10 2014 003 725.8 filed Mar. 18, 2014, the entireties of which are incorporated herein by reference.

FIELD OF THE INVENTION

The present invention concerns a wall element

DESCRIPTION OF RELATED ART

From JP 100 72 883 A there is known a wall element, which comprises a felt panel, wherein the felt panel has at least two felt layers and wherein at least one felt layer has a three-dimensional structure on at least one top side. The production of such a wall element is technically difficult due to the cutting process.

SUMMARY OF THE INVENTION

The object of the present invention aims to solve is to propose a wall element which comprises an at least three-layered pure felt panel, which in particular is fabricated in one volume region with avoidance of full-surface connections. Furthermore, the present invention aims to solve the problem of an easy fabrication process for the felt layer. Finally, the present invention aims to solve the problem of easily adapting the wall element in its thickness by additional felt layers, in order to satisfy the most diverse requirements.

In the wall element as claimed in the present invention, which comprises a felt panel, the felt panel comprises as its top layer a plane felt layer, as is bottom layer a plane felt layer, and as its middle layer at least one corrugated felt layer, wherein the corrugated felt layer bordering on the top layer is connected to the top layer on its top side in the region of upper vertex lines or vertex points formed by its wave peaks and wherein the corrugated felt layer bordering on the bottom layer is connected to the bottom layer on its bottom side in the region of lower vertex lines or vertex points formed by its wave valleys. In this way, a pure at least three-layered composite is produced, in which full-surface connections between the individual felt layers are avoided. Thanks to using a corrugated felt layer on the top side and bottom side, one can avoid material build-up in the case of three-layered and multilayered felt panels. Due to the make-up of the felt panel from plane felt layers and at least one felt layer corrugated on both sides, the fabrication process only comprises the steps of cutting, shaping of a portion of the cut pieces, and joining all of the cut pieces. In particular, a splitting of a single felt layer which is critical in terms of process safety is not required in the composition as claimed in the present invention.

Furthermore, it is provided in a felt panel comprising two or more corrugated felt layers in contact to orient the corrugated felt layers in contact with each other in relation to each other such that their vertex lines run in parallel planes and make an angle with each other of at least 20° and especially 90°. In this way, the felt panel has a bending rigidity oriented in multiple directions.

It is also provided, in the felt panel as middle layer, to have at least two corrugated felt layers and each time a plane felt layer as intermediate layer between the corrugated felt layers, wherein each corrugated felt layer is connected to the respective adjacent intermediate layer or intermediate layers in the region of upper vertex lines or vertex points formed by their wave peaks and/or in the region of lower vertex lines or vertex points formed by their wave peaks. This make-up of the felt panel ensures that all felt layers of the felt panel are joined to each other by a plurality of line-shaped or point-shaped connections.

Also for a felt panel which comprises plane felt layers as intermediate layers it is provided to orient corrugated felt layers which are connected to the same plane felt layer in such a way to each other that their vertex lines run in parallel planes and stand at an angle to each other of at least 20° and especially 90°. In this way, the felt panel is given a bending rigidity oriented in multiple directions.

It is provided that the felt panel is configured with a thickness between 10 mm and 50 mm, preferably between 20 mm and 40 mm and especially around 30 mm. Felt panels of such dimensions are good for use as a pin board or partition wall.

For the corrugated felt layer, it is provided to use a plane felt layer with a thickness between 4 mm and 20 mm, preferably 6 mm and 15 mm and especially around 8 mm, while the corrugated felt layer is produced by a pressing process. Such felt layers have a good natural stability, which facilitates the processing, since such felt layers can be easily handled without forming unwanted kinks during the handling process.

It is provided to form cavities between the wave peaks of the corrugated felt layer or felt layers and between the wave valleys of the corrugated felt layer or felt layers. In this way, the bending and torsional rigidity of the felt panel is increased and this also improves both the soundproofing properties and the thermal insulating properties of the felt panel.

It is furthermore provided to configure the felt panel with at least one island region, in which the plane felt layers and the at least one corrugated felt layer lie in full-surface and planar manner on each other and in particular are joined together by their full surface. Thanks to the formation of one or more island regions it is possible to further improve the mechanical properties of the felt panel and in particular to also give an adequate natural stability to large felt panels with side lengths in the meter range.

It is provided to configure the island region as an edge region which is closed all around. In this way, the cavities are closed off toward a periphery of the felt panel and are thus protected against damage and/or soiling. Furthermore, the felt panel is strengthened by the ring formed by the island region.

The felt panel has a thickness in a volume region bordering on the at least one island region which is greater than a thickness of the felt panel in the at least one island region, the thicknesses being measured each time orthogonally to the extension of one of the plane felt layers. Thanks to the lesser thickness in the island region, the island regions are especially easy to process.

It is also provided to configure the island region as an edge region, which runs around the felt panel at its periphery only in a segment, or to configure the island regions as edge regions which run around the felt panel at its periphery spaced apart from each other in several segments. In this way, the felt panel is strengthened and at the same time also maintains open cavities so that the uptake and surrender of moisture in and out of the cavities is further maintained.

It is also provided that the wall element comprises a support, besides the felt panel. Thanks to a support interacting with the felt panel it is possible to position the felt panel securely against shifting and to further strengthen it.

It is provided to configure the support with a foot and at least one rod, wherein the rod is so adapted to one of the cavities of the felt panel that it can be inserted into the cavity such that the felt panel is carried by the support. In this way, an easy connection of rod and support is securely produced.

Furthermore, it is provided to outfit the support with at least one rod, wherein the rod runs through one of the cavities so that it projects on both sides and at the end from the felt panel.

For the connecting of the individual felt layers it is provided that these are connected by a connection process making use of an additive, especially by a gluing process making use of an adhesive and/or by an additive-free connection process, especially a welding process, preferably ultrasound welding or vibration welding. Such methods can be carried out with simple technical means.

In the sense of the present invention, a corrugated felt layer is taken to mean both an arc-shaped corrugated felt layer and a zig zag corrugated felt layer, as well as a corrugated felt layer which is trapezoidal in cross section, which is produced in particular in a shaping process, especially making use of an embossing die, especially under the action of heat. In the sense of the present invention, for a corrugated felt layer which is trapezoidal in cross section, by upper and lower vertex lines are meant the upper and lower vertex surfaces.

Further details of the present invention shall be described in the drawing with the aid of schematically represented sample embodiments.

DETAILED DESCRIPTION OF THE INVENTION

Figure 1:
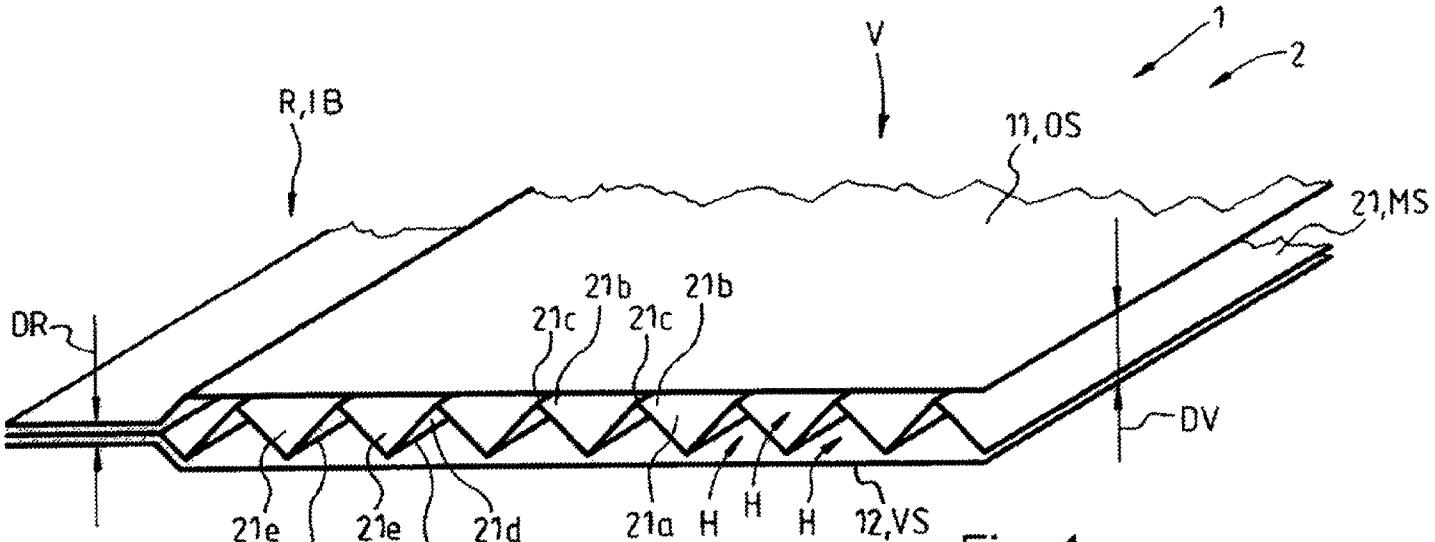
FIG. 1 shows a cutout of a perspective view of a first wall element, which comprises a first felt panel, wherein the felt panel comprises a corrugated felt layer and two plane felt layers.

FIG. 1 shows a perspective view of a cutout of a first wall element 1, which comprises a first felt panel 2, wherein the felt panel 2 shows a corrugated felt layer 21 and two plane felt layers 11, 12. The first plane felt layer 11 forms a top layer OS, the second plane felt layer 12 forms a bottom layer US and the corrugated felt layer 21 forms a middle layer MS. The corrugated felt layer 21 bordering on the top layer OS is connected to the top layer OS on its top side **21*a* in the region of upper vertex lines 21*c* formed by its wave peaks 21*b*. The corrugated felt layer 21 bordering on the bottom layer US is connected to the bottom layer US on its bottom side 21*d* in the region of lower vertex lines 21*f* formed by its wave valleys 21*e*. The connections between the felt layers 11, 12 and 21 are produced here by an adhesive, not shown. The corrugated felt layer 21 is configured as a zig zag corrugated felt layer 21 and is formed in a pressing mold between two dies from a plane felt layer. In an island region IB, which is formed by a circumferential edge region R, the corrugated felt layer 21 is pressed flat between the plane felt layers 11 and 12 and bonded to them by its full surface. In a nondeformed volume region V one can notice how each time cavities H are formed by the three-dimensional configuration of the felt layer 21 between its wave peaks 21***b* and the upper felt layer 11 as well as between its wave valleys 21*e* and the lower felt layer 12, which run parallel to each other. In the volume region V the felt panel 2 has a thickness DV, which is greater than a thickness DR which the felt panel 2 has in the edge region R. Together with the felt material used for the felt panel 2, these cavities H give the wall element 1 especially good properties as a sound-proofing component. Furthermore, the pure material make-up of the felt panel 2 facilitates a recycling of the felt panel 2.

Figure 2:
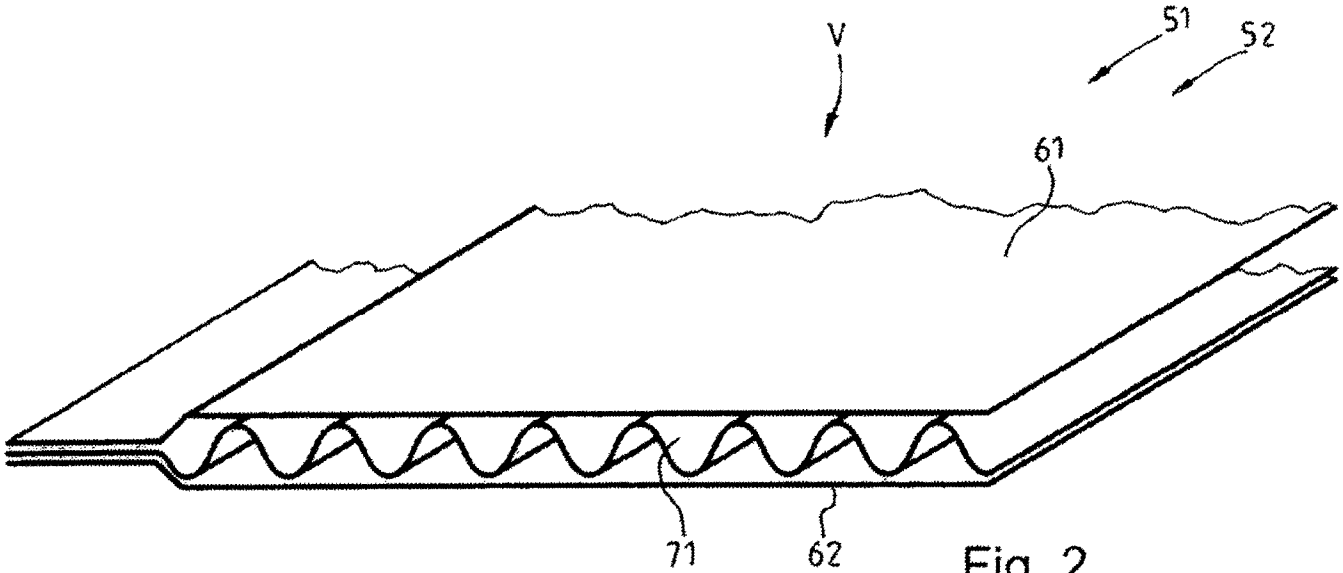
FIG. 2 shows a cutout of a perspective view of a second wall element, which comprises a second felt panel, wherein the felt panel comprises a corrugated felt layer and two plane felt layers.

FIG. 2 shows a perspective view of a cutout of a second wall element 51, which comprises a second felt panel 52, wherein the felt panel 52 shows a corrugated felt layer 71 and two plane felt layers 61, 62 in a volume region V. The wall element 51 is designed comparably to the wall element shown in FIG. 1. Only the corrugated felt layer 71 in contrast to FIG. 1 is configured not as a zig zag corrugated felt layer, but rather as a wavy corrugated felt layer.

Figure 3:
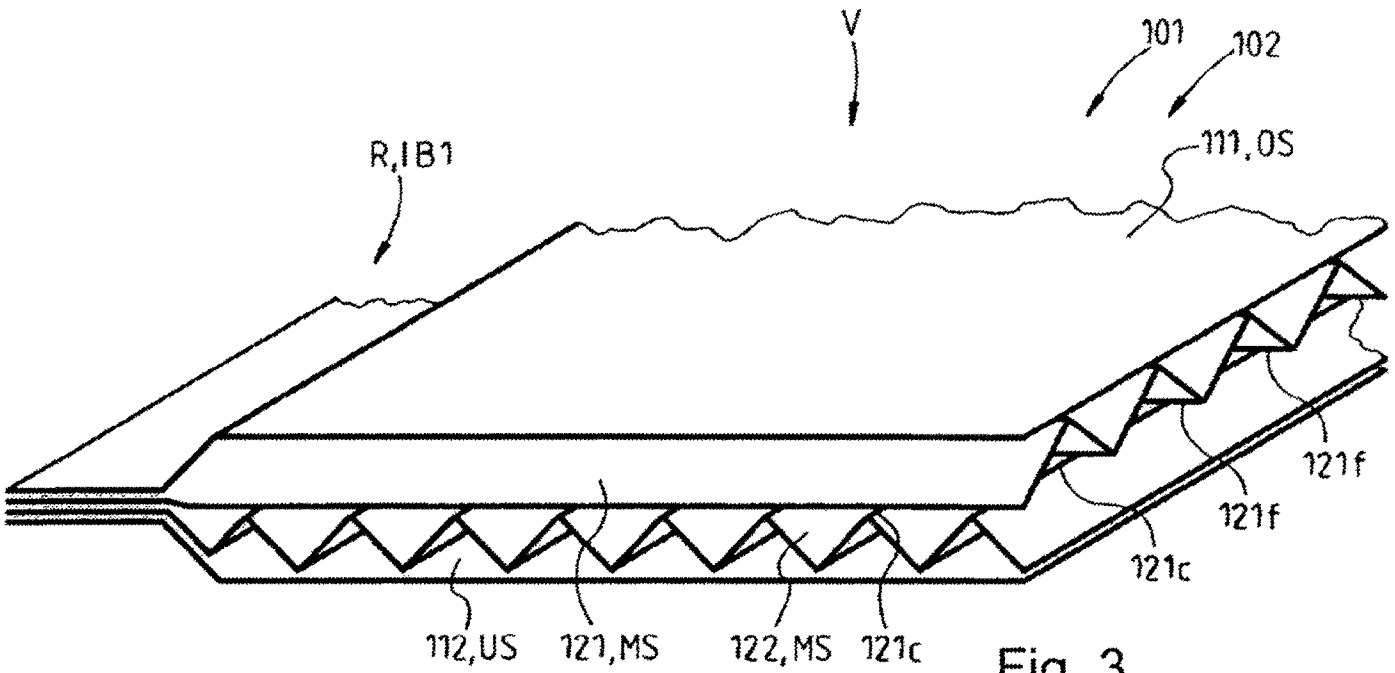
FIG. 3 shows a cutout of a perspective view of a third wall element, which comprises a third felt panel, wherein the felt panel comprises two corrugated felt layers and two plane felt layers.

FIG. 3 shows a perspective view of a cutout of a third wall element 101, which comprises a third felt panel 102, wherein the felt panel 102 comprises two corrugated felt layers 121, 122 and two plane felt layers 111, 122. As for the basic make-up of the third felt panel 102, refer to the description of FIG. 1. The plane felt layer 111 forms a top layer OS and the plane felt layer 112 forms a bottom layer US. The corrugated felt layers 121 and 122 form a middle layer MS. The felt layers 111 and 121 and the felt layers 112 and 122 here are joined in a volume region V of the wall element 101, as described in FIG. 1. The upper corrugated felt layer 121 is joined by lower vertex lines 121*f* in pointlike manner to upper vertex lines 122*c* of the lower corrugated felt layer 122, since the vertex lines 121*f* and 122*c* of the two corrugated felt layers 121 and 122 run at an angle of 90° to each other. An island region IB1 configured as an edge region R of the wall element 101 and the felt panel 102 is configured as four-ply, wherein all four felt layers are pressed flat and glued together.

Figure 4:
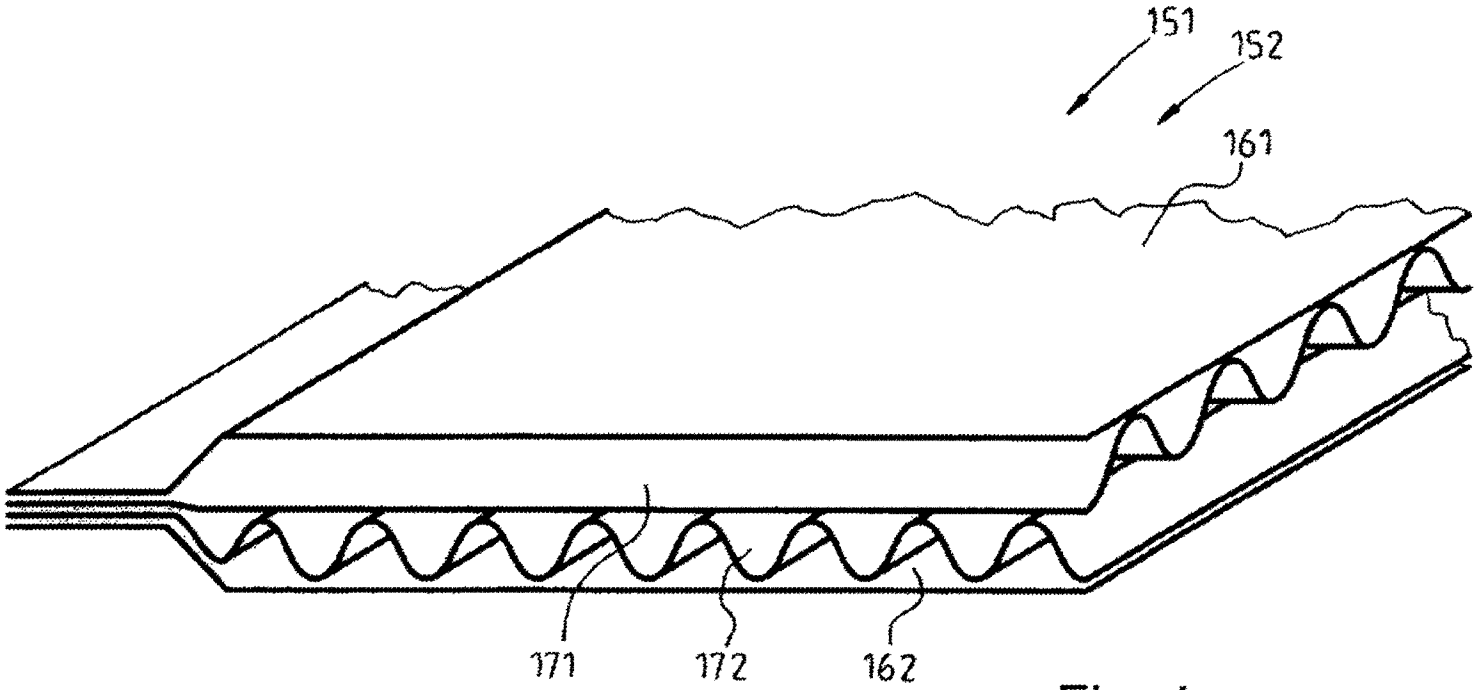
FIG. 4 shows a cutout of a perspective view of a fourth wall element, which comprises a fourth felt panel, wherein the felt panel comprises two corrugated felt layers and two plane felt layers.

FIG. 4 shows a perspective view of a cutout of a fourth wall element 151, which comprises a fourth felt panel 152, wherein the felt panel 152 comprises two corrugated felt layers 171, 172 and two plane felt layers 161, 162. The wall element 151 is designed comparably to the wall element shown in FIG. 3. Only the corrugated felt layers 171, 172 in contrast to FIG. 3 are configured not as zig zag corrugated felt layers, but rather as wavy corrugated felt layers.

Figure 5:
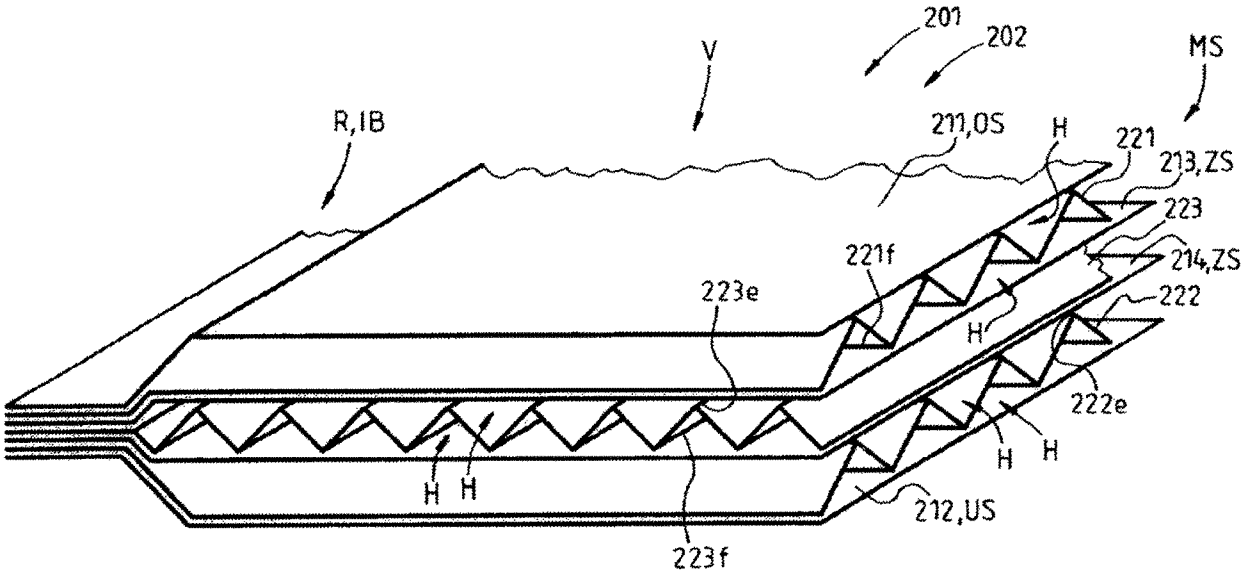
FIG. 5 shows a cutout of a perspective view of a fifth wall element, which comprises a fifth felt panel, wherein the felt panel comprises three corrugated felt layers and four plane felt layers.

FIG. 5 shows a perspective view of a cutout of a fifth wall element 201, which comprises a fifth felt panel 202, wherein the felt panel 202 comprises three corrugated felt layers 221, 222, 223 and four plane felt layers 211, 212, 213, 214. The first plane felt layer 211 forms a top layer OS, the second plane felt layer 212 forms a bottom layer US. The third and fourth plane felt layers 213, 214 form intermediate layers ZS, which lie between the corrugated felt layers 221, 222, 223 and form with them the middle layer MS. As for the basic make-up of the fifth felt panel 202, refer to the description of FIG. 1. The felt layers 211 and 221 and the felt layers 212 and 222 are joined in a volume region V of the wall element 201 as described for FIG. 1. In the volume region V, the upper corrugated felt layer 221 is joined by lower vertex lines 221*f* to the upper intermediate layer ZS or 213 and the lower corrugated felt layer 221 is joined by upper vertex lines 222*e* to the lower intermediate layer ZS or 214. The middle corrugated felt layer 223 is joined by upper vertex lines 223*e* to the upper intermediate layer ZS or 213 and by lower vertex lines 223*f* to the lower intermediate layer ZS or 214. An island region fashioned as an edge region R of the wall element 201 or the felt panel 202 is configured as seven-ply, wherein all seven felt layers are pressed flat and glued together. Cavities H of the upper and lower corrugated felt layer 221, 222 run parallel to each other. Cavities H of the middle corrugated felt layer 223 run transversely to them.

Figure 6:
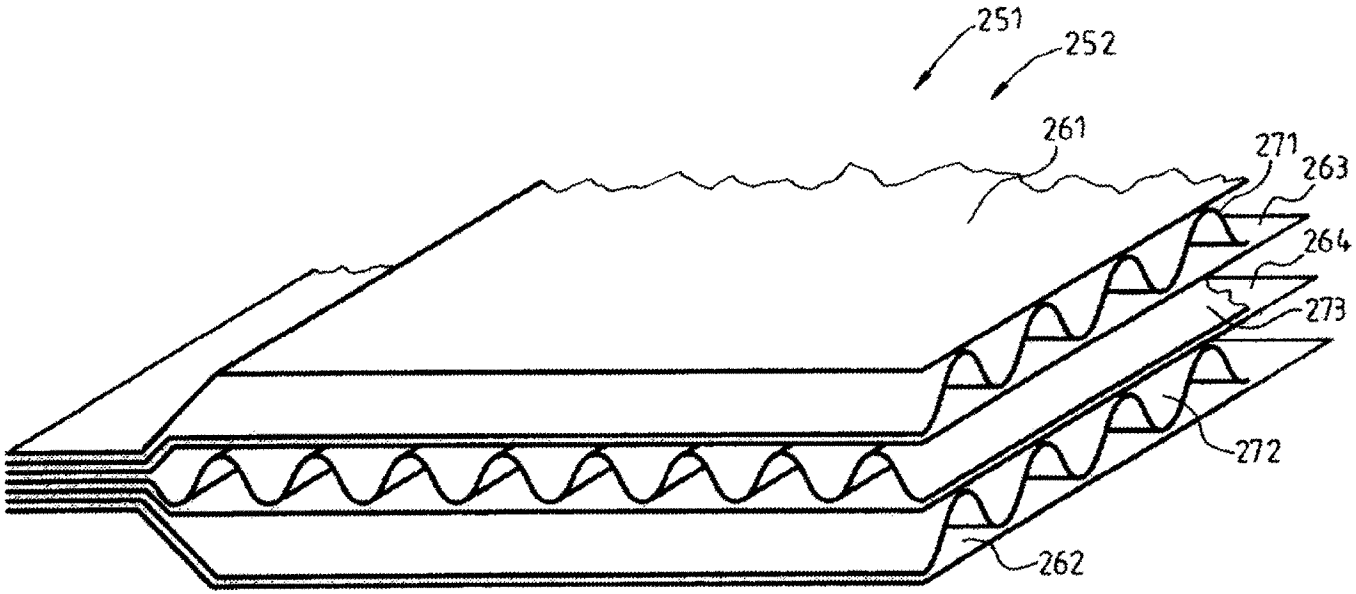
FIG. 6 shows a cutout of a perspective view of a sixth wall element, which comprises a sixth felt panel, wherein the felt panel comprises three corrugated felt layers and four plane felt layers.

FIG. 6 shows a perspective view of a cutout of a sixth wall element 251, which comprises a sixth felt panel 252, wherein the felt panel 252 comprises three corrugated felt layers 271, 272, 273 and four plane felt layers 261, 262, 263, 264. The wall element 251 is designed comparably to the wall element shown in FIG. 5. Only the corrugated felt layers 271, 272, 273 in contrast to FIG. 5 are configured not as zig zag corrugated felt layers, but rather as wavy corrugated felt layers.

Figure 7:
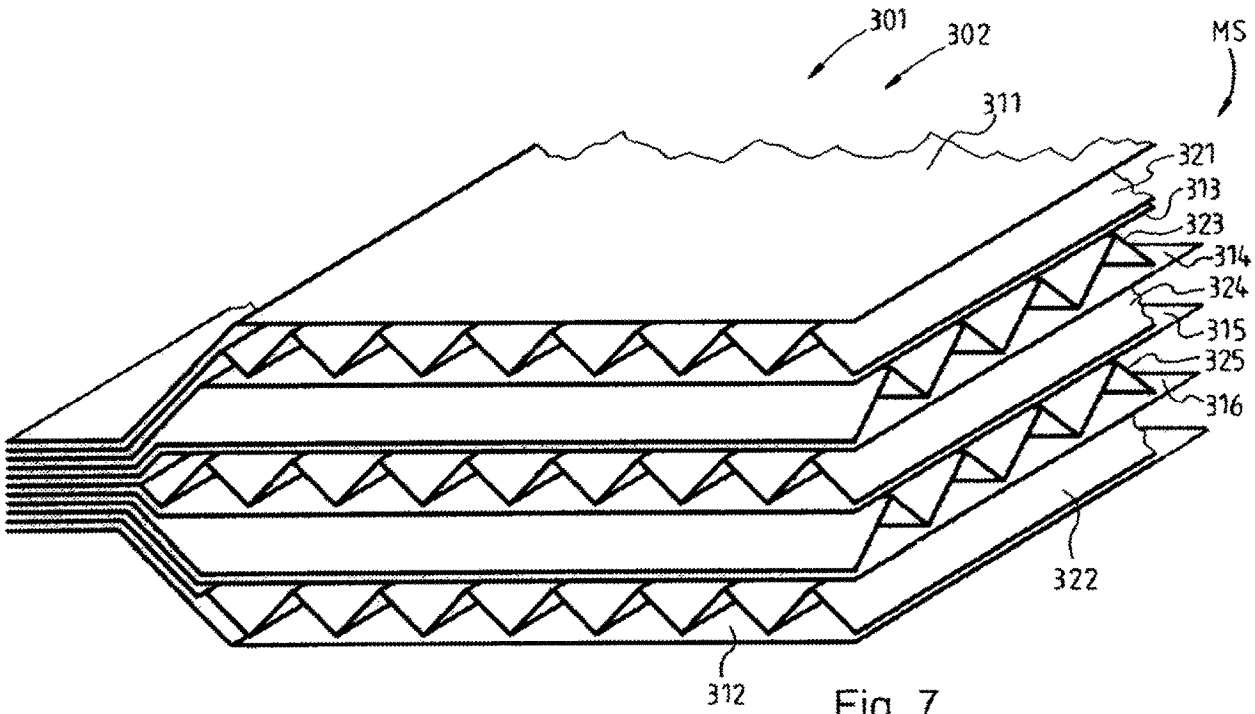
FIG. 7 shows a cutout of a perspective view of a seventh wall element, which comprises a seventh felt panel, wherein the felt panel comprises five corrugated felt layers and six plane felt layers.

FIG. 7 shows a perspective view of a cutout of a seventh wall element 301, which comprises a seventh felt panel 302, wherein the felt panel 302 comprises five corrugated felt layers 321 to 325 and six plane felt layers 311 to 316. As for the make-up, refer to the description of FIG. 5, since in the sample embodiment shown in FIG. 7 only a middle layer MS has been enlarged by further corrugated layers 324, 325 and further plane layers 315, 316, while the basic make-up of an alternating arrangement of corrugated and plane felt layers in the middle layer MS is retained.

Figure 8:
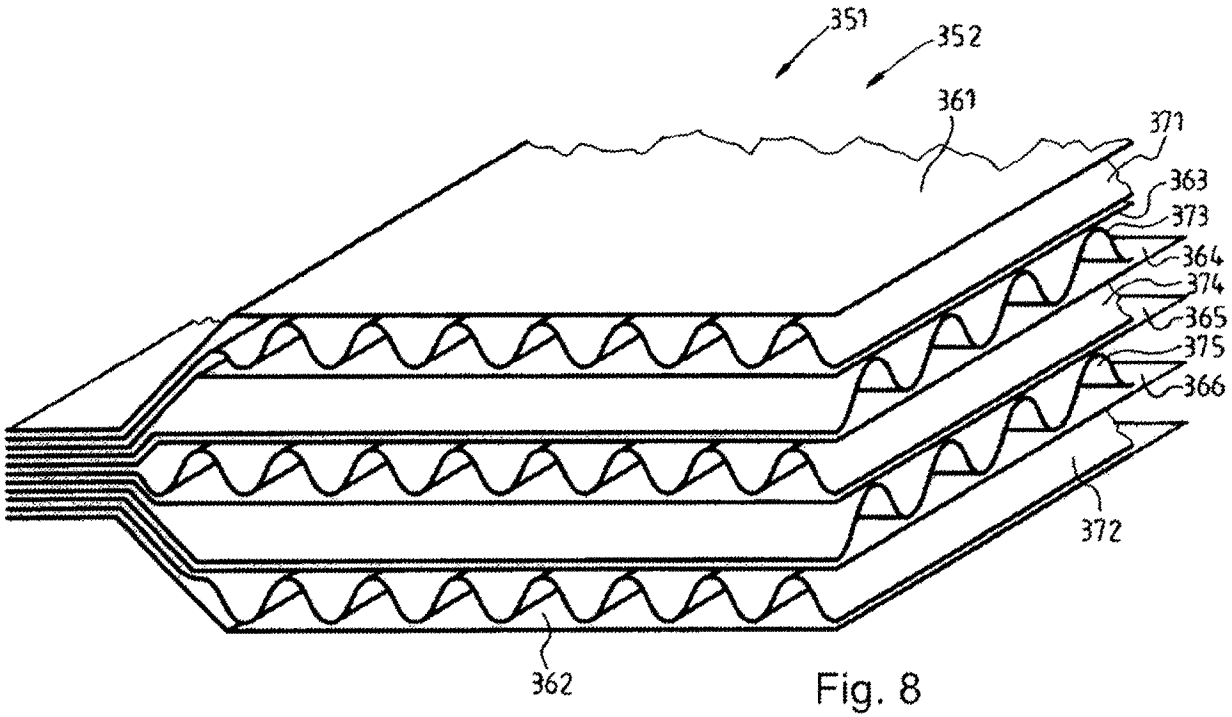
FIG. 8 shows a cutout of a perspective view of an eighth wall element, which comprises an eighth felt panel, wherein the felt panel comprises five corrugated felt layers and six plane felt layers.

FIG. 8 shows a perspective view of a cutout of an eighth wall element 351, which comprises an eighth felt panel 352, wherein the felt panel 352 comprises five corrugated felt layers 371 to 375 and six plane felt layers 361 to 366. The wall element 351 is designed comparably to the wall element shown in FIG. 7. Only the corrugated felt layers 371 to 375 in contrast to FIG. 7 are configured not as zig zag corrugated felt layers, but rather as wavy corrugated felt layers.

Figure 9:
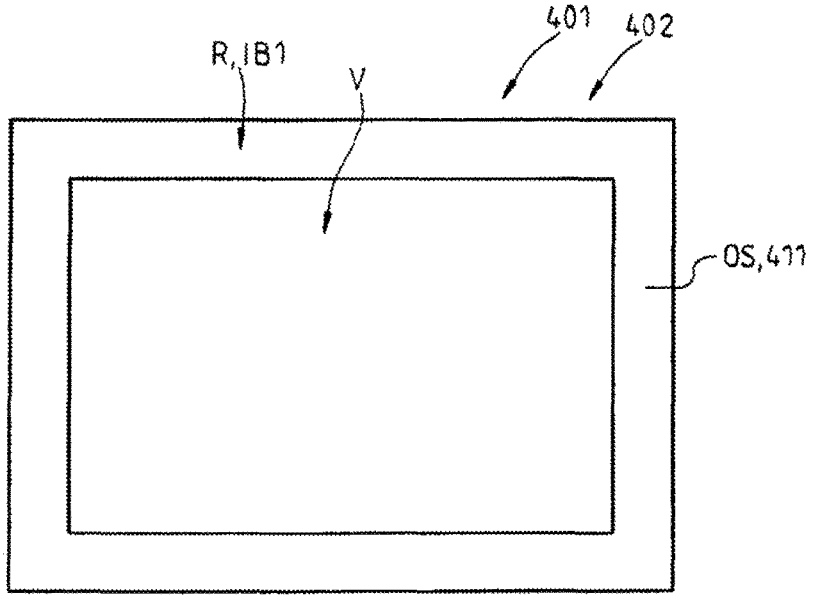
FIG. 9 shows a view of a ninth wall element, which comprises a ninth felt panel of square shape with an edge region closed all around.

FIG. 9 shows a view of a ninth wall element 401, which comprises a felt panel 402. The view here is a top view of a top layer OS of the felt panel 402, which is formed from a plane felt layer 411. In the top view, one can clearly recognize a volume region V and an island region IB1 entirely encircling the volume region V and configured as an edge region R. The felt panel 402 here is square in configuration both in the volume region V and in the island region IB1.

Figure 10:
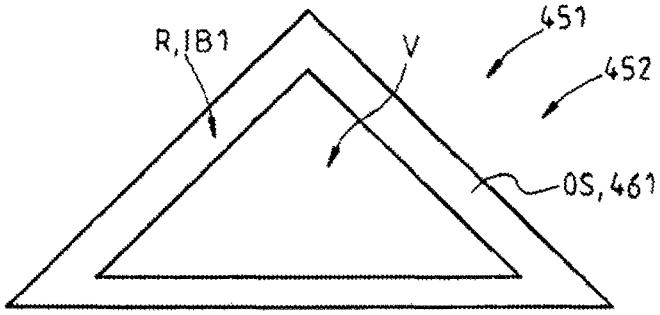
FIG. 10 shows a view of a tenth wall element, which comprises a tenth felt panel of triangular shape with an edge region closed all around.

FIG. 10 shows a view of a tenth wall element 451, which comprises a felt panel 452. The view here is a top view of a top layer OS of the felt panel 452, which is formed from a plane felt layer 451. In the top view, one can clearly recognize a volume region V and an edge region R entirely encircling the volume region V and configured as an island region IB1. The felt panel 452 here is triangular in configuration both in the volume region V and in the island region IB1.

Figure 11:
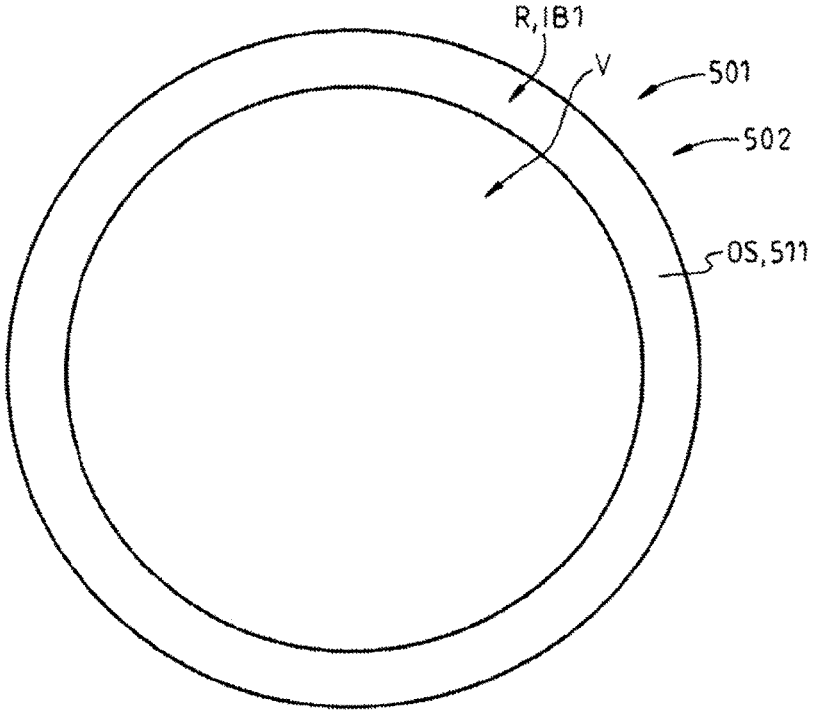
FIG. 11 shows a view of an eleventh wall element, which comprises an eleventh felt panel of round shape with an edge region closed all around.

FIG. 11 shows a view of an eleventh wall element 501, which comprises a felt panel 502. The view here is a top view of a top layer OS of the felt panel 502, which is formed from a plane felt layer 511. In the top view, one can clearly recognize a volume region V and an edge region R entirely encircling the volume region V and configured as an island region IB1. The felt panel 502 here is circular in configuration both in the volume region V and in the island region IB1.

Figure 12:
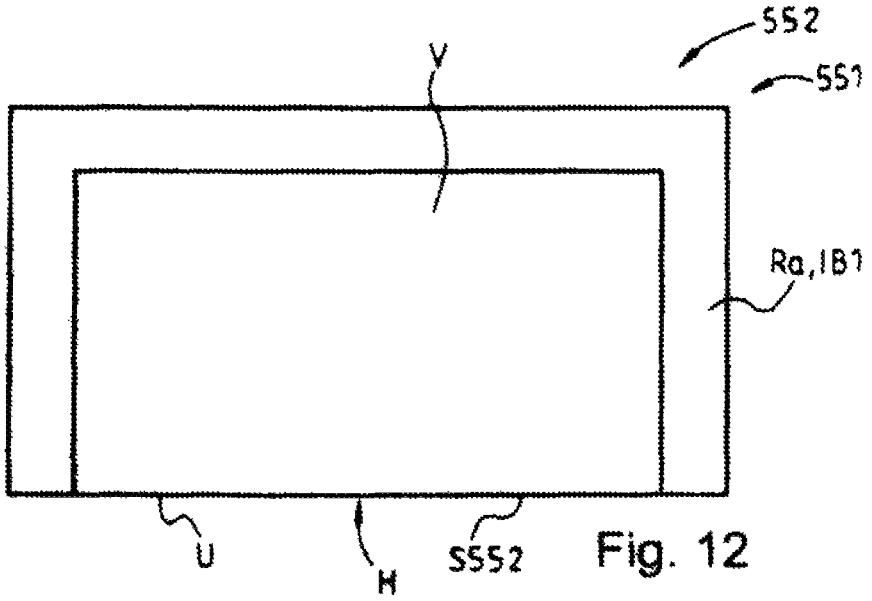
FIG. 12 shows a top view of a twelfth felt panel of a twelfth wall element, wherein the twelfth felt panel is of square shape with a three-sided closed edge region and a one-sided open edge region.

FIG. 12 shows a twelfth felt panel 522 of a twelfth wall element 551, wherein the twelfth felt panel 552 is square in configuration and comprises an island region IB1, which is configured as an edge region Ra enclosing three sides, so that a volume region V is configured open to one periphery U of the felt panel 552 at one side S552. Thus, cavities H of the felt panel 552 are open to this side.

Figure 13:
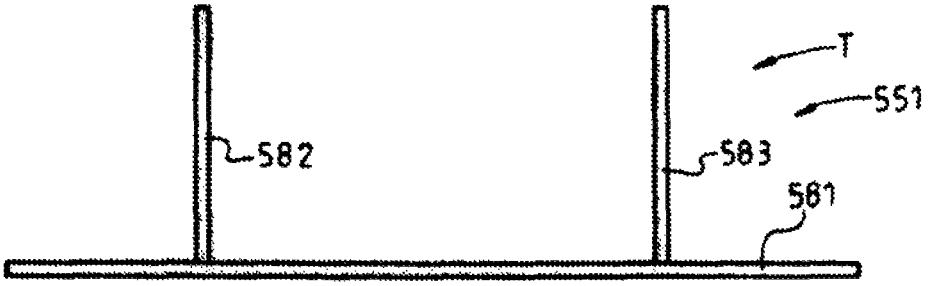
FIG. 13 shows a side view of a support of the twelfth wall element for the twelfth felt panel shown in FIG. 12.

FIG. 13 shows in side view a support T of the twelfth wall element 551. This is provided for assembly with the felt panel 552 shown in FIG. 12. The support T is composed of a stand 581 and two rods 582 and 583, joined to the stand 581.

Figure 14:
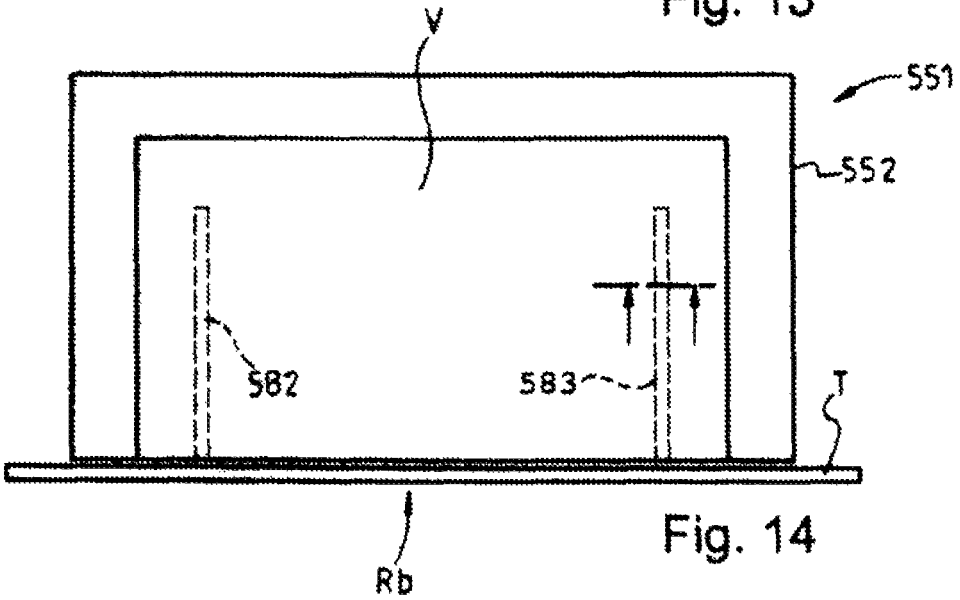
FIG. 14 shows the twelfth wall element, which is formed from the twelfth felt panel shown in FIG. 12 and the support shown in FIG. 13.
Figure 15:
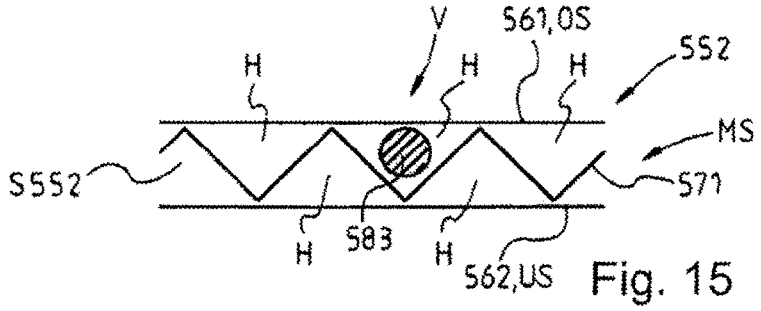
FIG. 15 shows a sectional view through FIG. 14 along sectioning line XV-XV.

FIG. 14 shows the twelfth wall element 551 in assembled form. For the assembly process, the support T was shoved by its rods 582 and 583 into the felt panel 552 at side S552 so that the rods 582, 583 are led into the cavities H (see FIG. 15), which are formed in the volume region V of the felt panel 552 in a middle layer MS. The arrangement of the rod 583 in the volume region V of the felt panel 552 can be seen from the sectional view shown in FIG. 15. The middle layer MS is formed by a corrugated felt layer 571, which lies between two plane felt layers 561 and 562, where these form a top layer OS and a bottom layer US.

Figure 16:
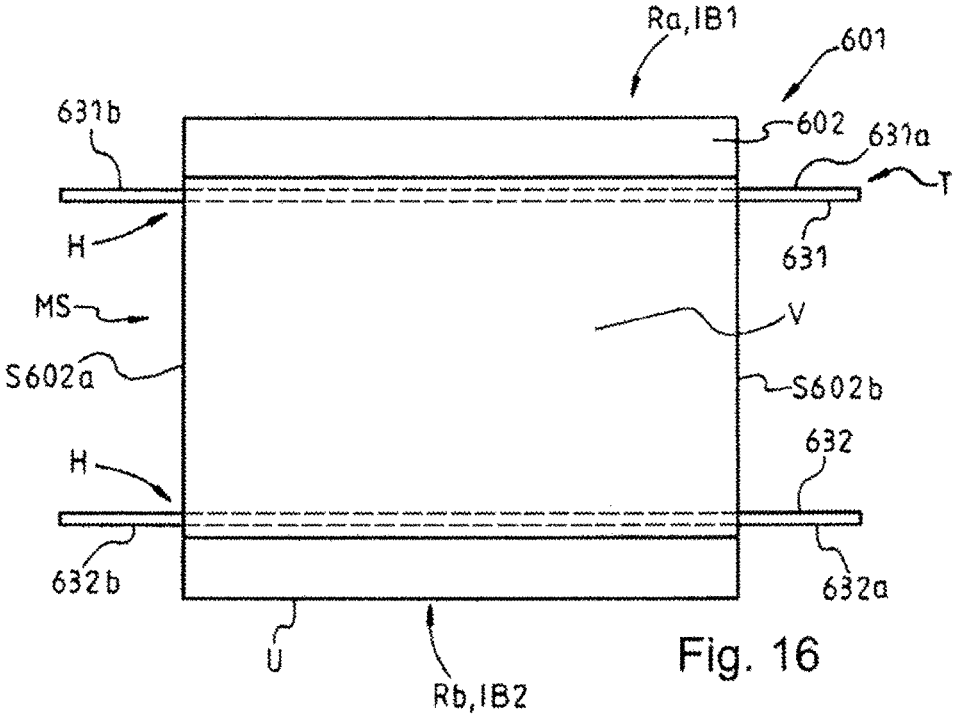
FIG. 16 shows a thirteenth wall element, wherein a felt panel of the thirteenth wall element has a two-sided closed edge region and a two-sided open edge region.

FIG. 16 shows a thirteenth wall element 601. The wall element 601 comprises a felt panel 602 and a support T, which is formed from two rods 631 and 632. The felt panel 602 has a volume region V as well as two opposite island regions IB1 and IB2 configured as edge regions Ra and Rb. Between the island regions IB1 and IB2, the volume region V is open at the periphery U of the felt panel 602 on two sides S602*a*, S602*b*. In the volume region V, the upper rod 631 passes through a cavity H formed in a middle layer MS of the felt panel 602. In the volume region V, the lower rod 632 likewise runs through a cavity H formed in the middle layer MS of the felt panel 602. At the ends 631*a*, 631*b* or 632*a*, 632*b* of the rods 631, 632, sticking out from the felt panel 602 it is easily possible to hang or secure the wall element 601.

Figure 17:
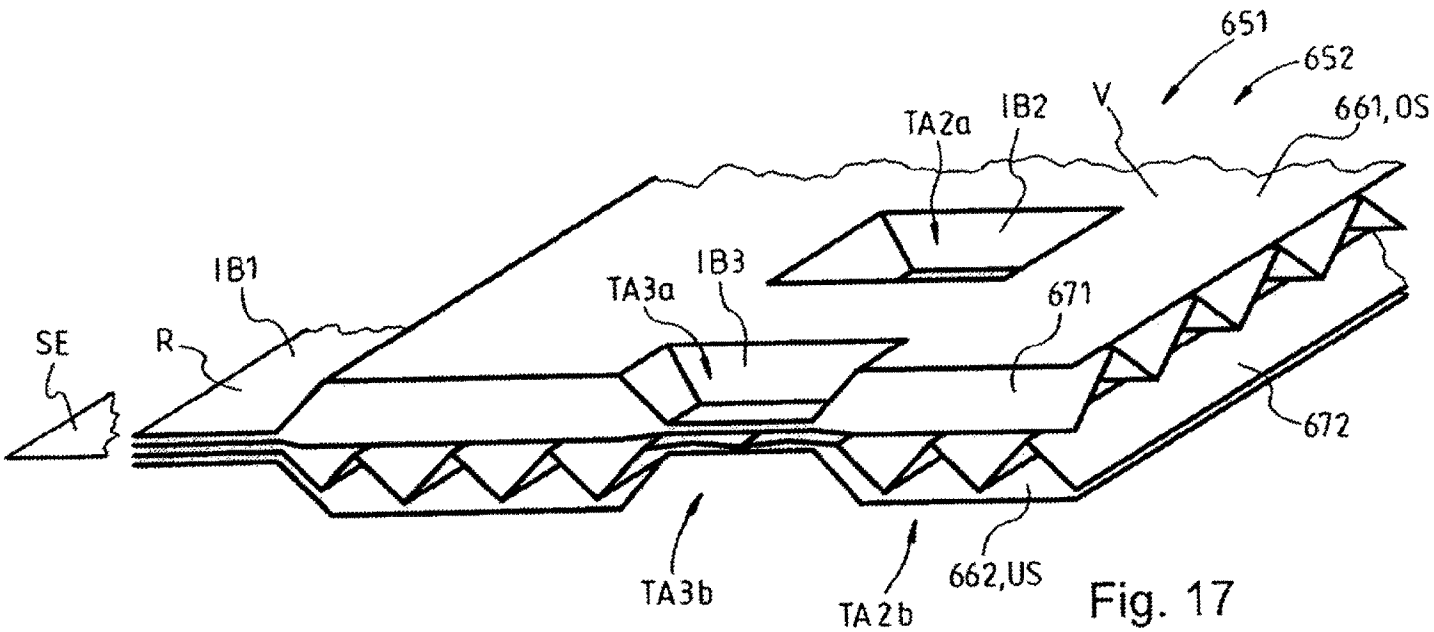
FIG. 17 shows a cutout of a perspective view of a fourteenth wall element, which corresponds in its make-up to the third wall element shown in FIG. 3, wherein one felt panel has three island regions.

FIG. 17 shows a cutout of a perspective view of a fourteenth wall element 651, which corresponds in its make-up to the third wall element shown in FIG. 3, wherein a felt panel 652 of the wall element 651 comprises three island regions IB1, IB2 and IB3. The first island region IB1 here is configured as an edge region R and the second and third island regions IB2 and IB3 are each arranged as middle islands in a volume region V of the felt panel 652, the two island regions IB2 and IB3 being arranged in mirror symmetry to a mirror plane SE, which lies between a first corrugated felt layer 671 and a second corrugated felt layer 672. The two island regions IB2 and IB3 here are each configured as double-sided pockets TA2*a* and TA2*b* or TA3*a* and TA3*b*, respectively, which are formed from outward lying plane felt layers 661 and 662, which form a top layer OS and a bottom layer US, such that the corrugated layers 671 and 672 are pressed flat. The four felt layers 661, 662, 671, 672 here are pressed flat and joined in the island regions IB2 and IB3.

Figure 18:
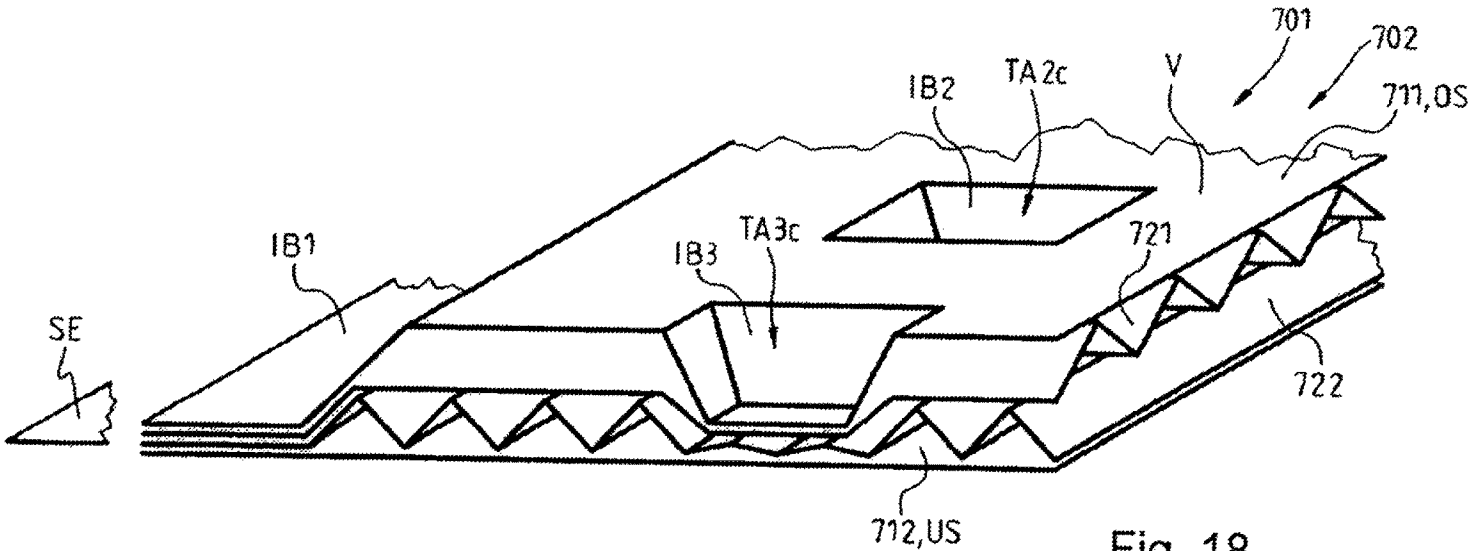
FIG. 18 shows a cutout of a perspective view of a fifteenth wall element, which corresponds in its make-up to the third wall element shown in FIG. 3, wherein one felt panel has three island regions.

FIG. 18 shows a cutout of a perspective view of a fifteenth wall element 701, which corresponds in its make-up to the third wall element shown in FIG. 3 and comprises a felt panel 702. Like the wall element shown in FIG. 17, the wall element 701 shown in FIG. 18 also has three island regions IB1, IB2 and IB3. In contrast with the felt panel shown in FIG. 17, these are arranged asymmetrically to a mirror plane SE, which lies between a corrugated felt layer 721 and a corrugated felt layer 722. The two island regions IB2 and IB3 here, configured as middle islands and surrounded by a volume region V of the felt panel 702, are configured such that a plane felt layer 711, which forms a top layer OS, is pressed down to a plane felt layer 712, which forms a bottom layer US. The two island regions IB2 and IB3 are configured such that the bottom layer US remains undeformed, the corrugated layers 721 and 722 are pressed flat on the bottom layer US and the top layer OS is deformed and deep drawn so much that it lies flat on the upper corrugated layer 721 in the respective island region IB2 or IB3, while all four layers 711, 712, 721 and 722 are joined together. The second and third island regions IB2 and IB3 are each configured as single-sided pockets TA2*c* and TA3*c*.

Figure 19:
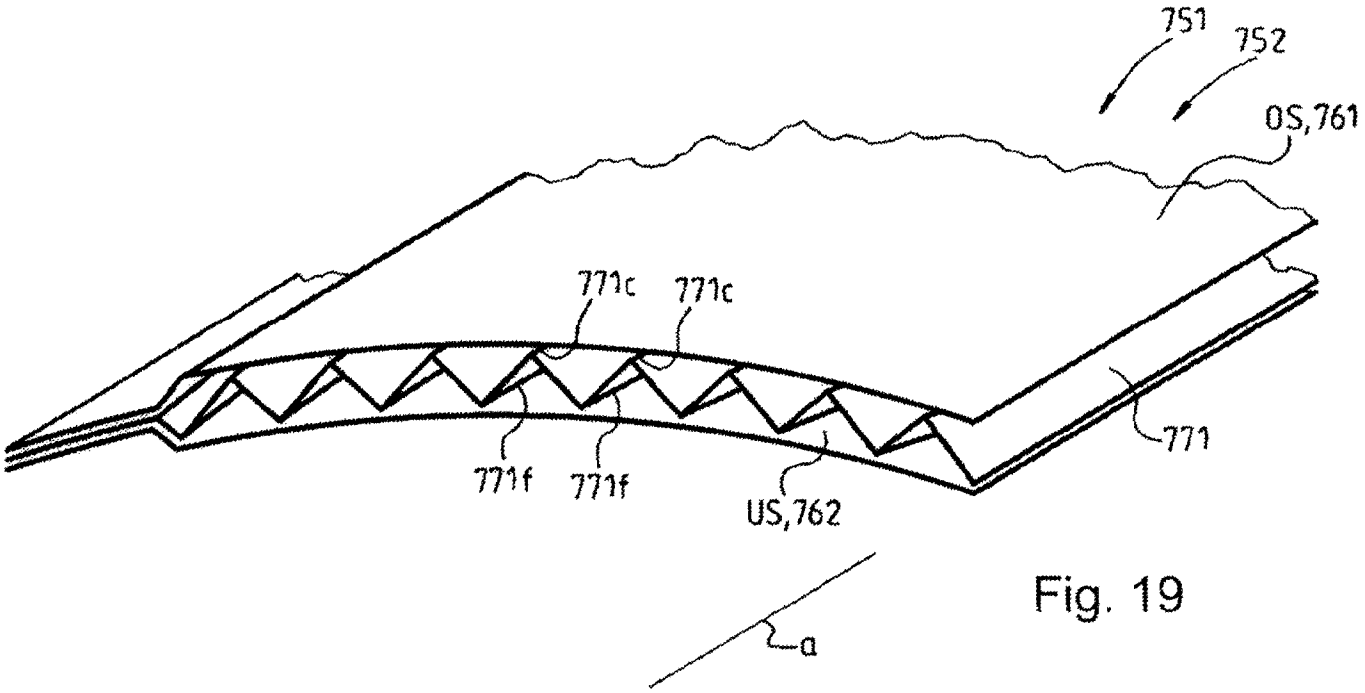
FIG. 19 shows a cutout of a perspective view of a sixteenth wall element, which corresponds in its make-up to the first wall element shown in FIG. 1, wherein one felt panel is arched and FIGS. **20*a*-20*l*** shows further variant embodiments of wall elements or their individual layers.

FIG. 19 shows a cutout of a perspective view of a sixteenth wall element 751, which corresponds in its make-up to the first wall element shown in FIG. 1, wherein a felt panel 752 is arched in configuration. The felt panel 752 here is arched about an axis a, which is oriented parallel to upper or lower vertex lines 771*c* or 771*f* of a corrugated felt layer 771. Preferably a connection is only produced between top layer OS or 761 and corrugated felt layer 771 and corrugated felt layer 771 and a bottom layer US or 762 when the felt panel 752 has been curved about the axis a.

It is also provided to have at least one opening or one borehole in at least one island region and/or in at least one volume region of the felt panel, so that a wall element formed by the felt panel can be fastened, e.g., by at least one hanger such as a screw or a nail or a hook.

The above described wall elements are especially intended for use as a pin board and/or as a room divider.

Figure 20A:
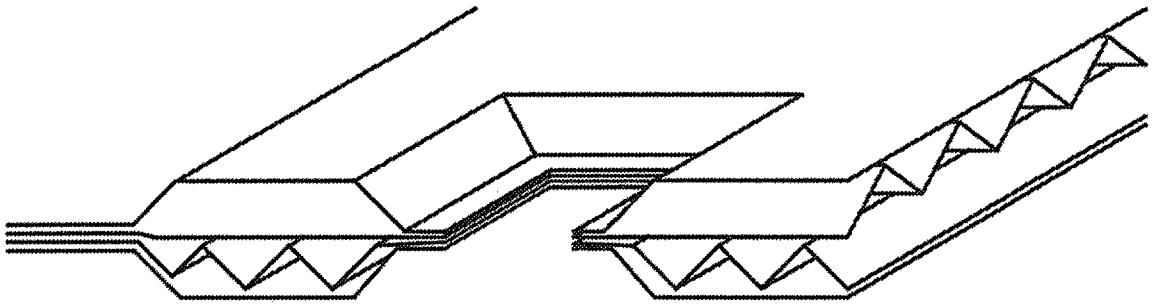

FIGS. 20*a* to 201 schematically represent further variant embodiments of wall elements or individual layers of these wall elements.

FIG. 20*a* shows a wall element which has a point compression, in the region of which all felt layers lie flat one on another and are joined together. In this way, the wall element is strengthened by the assemblage of the individual felt layers. Optionally it is provided to have an opening in the form of a notch within the point compression, by which a light transparency of the wall element is achieved, without it being weakened in this way.

Figure 20B:
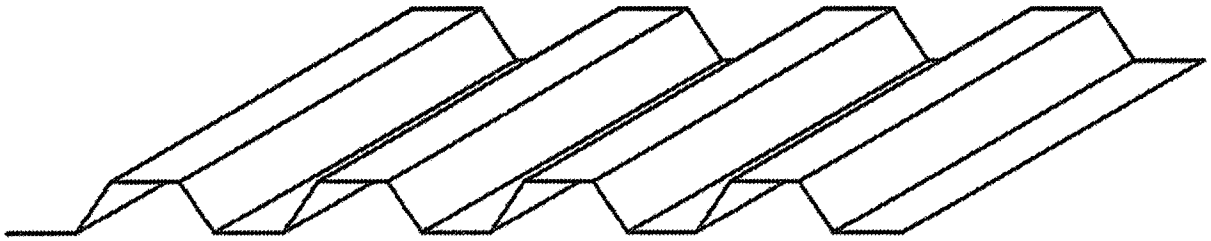

FIG. 20*b* shows a corrugated felt layer in individual representation, which is fashioned as a corrugated felt layer of trapezoidal cross section and whose vertex lines are formed by vertex surfaces. Such corrugated felt layers of trapezoidal cross section will be used in the other wall elements represented in FIGS. 20*c* to 201.

Figure 20C:
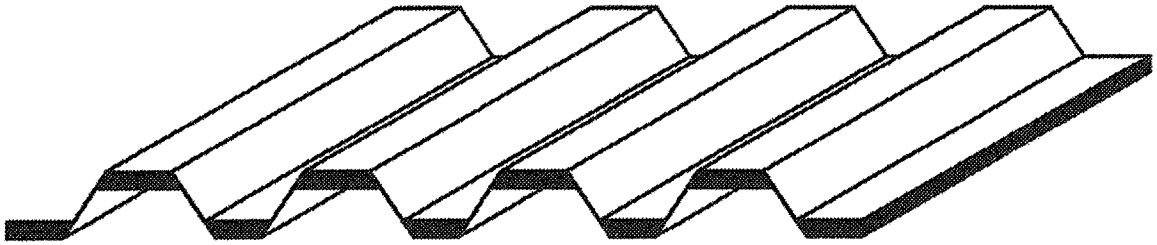

FIG. 20*c* shows a wall element which is formed from two corrugated felt layers of trapezoidal cross section, which are laid form-fitting one in another and which are joined together by different pressing force in different sections. This is accomplished in that the vertex surfaces of the two felt layers are joined together with less pressure than the opposing diagonal surfaces of the two felt layers, so that the wall element is thicker in the region of the vertex surfaces than in the region of the diagonal surfaces and the thickness in the region of the vertex surfaces in particular is at least 1.5 times and preferably 2 times the thickness in the region of the diagonal surfaces. This produces a wall element having good soundproofing properties. It is also provided in addition to embed this wall element between two plane felt layers and thereby produce a four-ply wall element, which is stabilized by the plane felt layers in its geometrical shape.

Figure 20D:
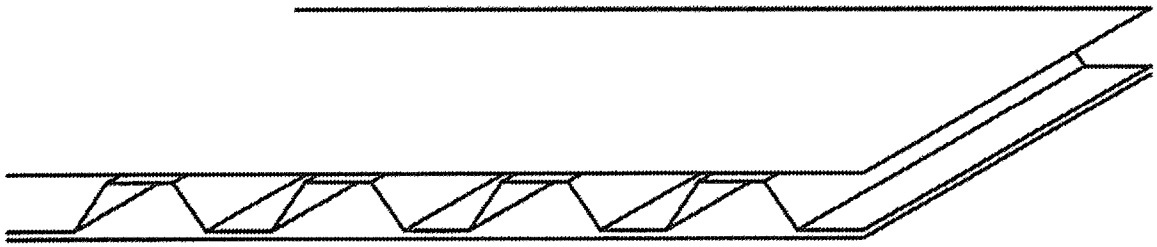

FIG. 20*d* shows another wall element, which is formed from a corrugated felt layer as shown in FIG. 20*b* and two plane felt layers arranged on top side and bottom side, the corrugated felt layer being joined by its vertex surfaces to the upper and lower plane felt layers so that the geometrical shape of the corrugated felt layer is stabilized.

Figure 20E:
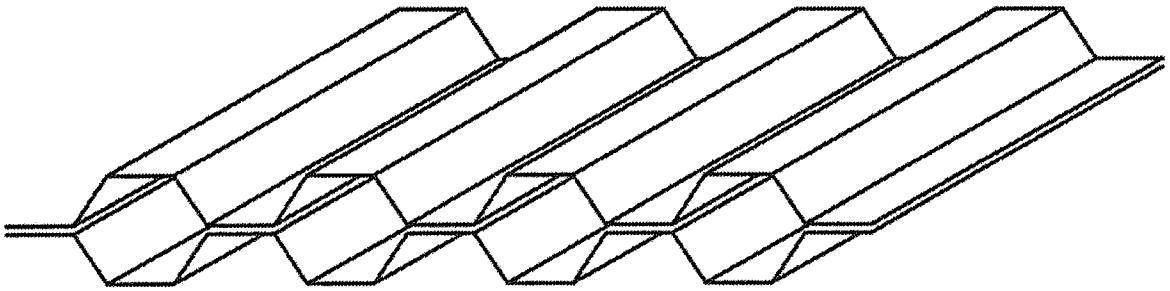

FIG. 20*e* shows a wall element which is formed from two corrugated felt layers corresponding to FIG. 20*b*. These are oriented to each other such that they are congruent with each other by a portion of their vertex surfaces, so that cavities of hexagonal cross section are formed between them, which run parallel to each other. Here as well a further stabilization of the wall element is optionally provided by adding two plane felt layers, which are put in place as upper and lower cover layer and joined to the described structure in the region of the vertex surfaces.

Figure 20F:
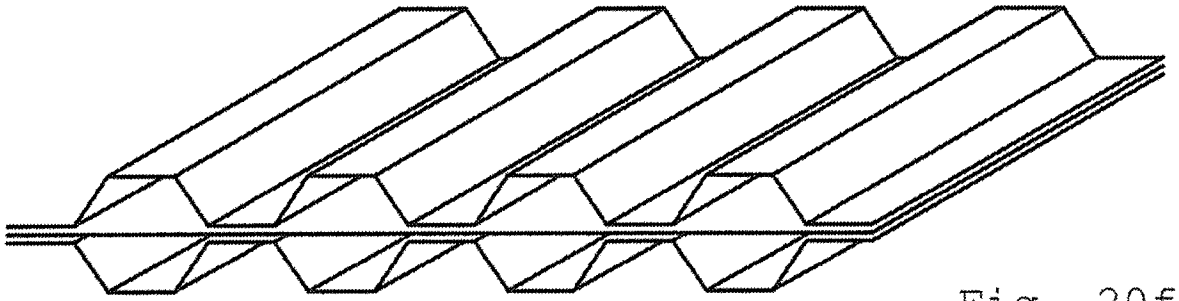

FIG. 20*f* describes a further wall element, which differs from the wall element shown in FIG. 20*e* in that here a plane felt layer is arranged between the two corrugated felt layers, which divides the hollow tubes in half.

Figure 20G:
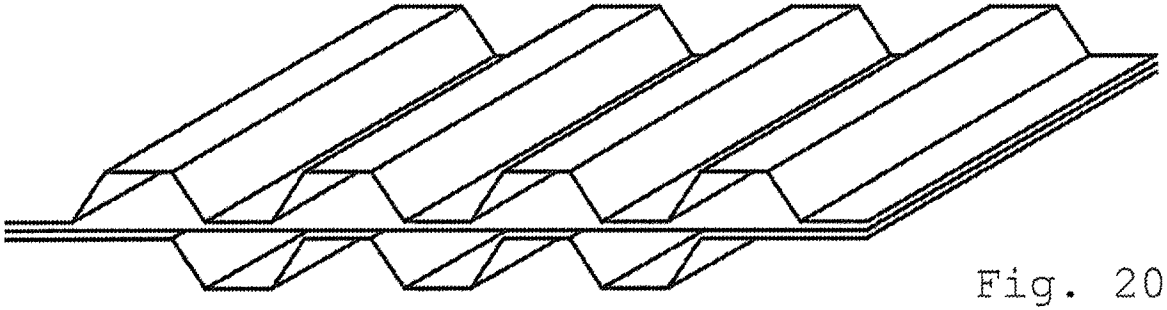

FIG. 20*g* describes a further wall element, which differs from the wall element shown in FIG. 20*f* in that here the two corrugated felt layers are displaced with respect to each other, so that alternating cavities are formed in relation to the plane felt layer, yet which are still oriented parallel to each other in their course.

Figure 20H:
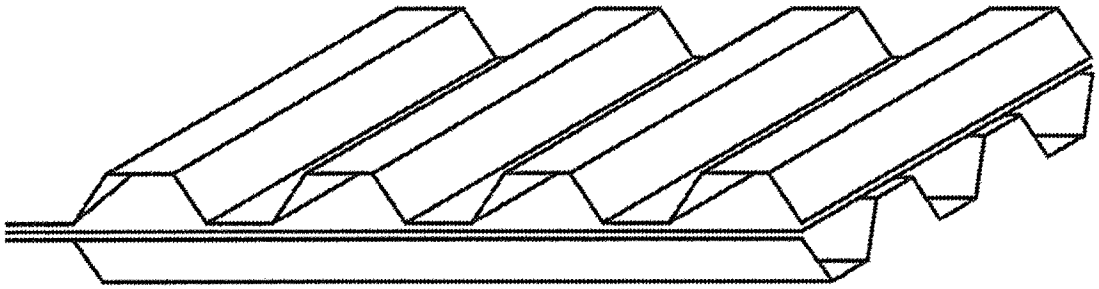

FIG. 20*h* describes a further wall element, which differs from the wall element shown in FIG. 20*f* in that here the two corrugated felt layers are rotated by 90° relative to each other about a vertical axis, where the vertical axis is perpendicular to the wall element.

Figure 20I:
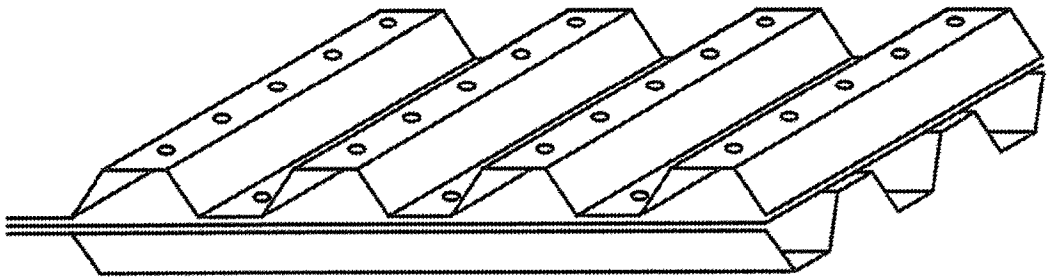

FIG. 20*i* describes a further wall element, which differs from the wall element shown in FIG. 20*f* in that here the two corrugated felt layers are rotated by 90° relative to each other about a vertical axis, where the vertical axis is perpendicular to the wall element, and the upper corrugated layer has openings which alter the acoustic properties and the optics.

Figure 20J:
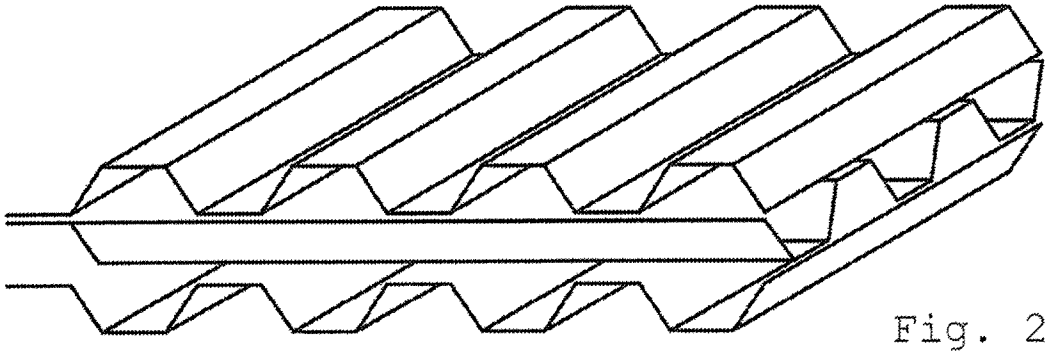

FIG. 20*j* describes a further wall element, which differs from the wall element shown in FIG. 20*e* in that here a further corrugated felt layer is arranged between the corrugated felt layers as a middle layer, which is rotated with respect to the upper and the lower corrugated felt layer by 90° about a vertical axis, where the vertical axis is perpendicular to the wall element.

Figure 20K:
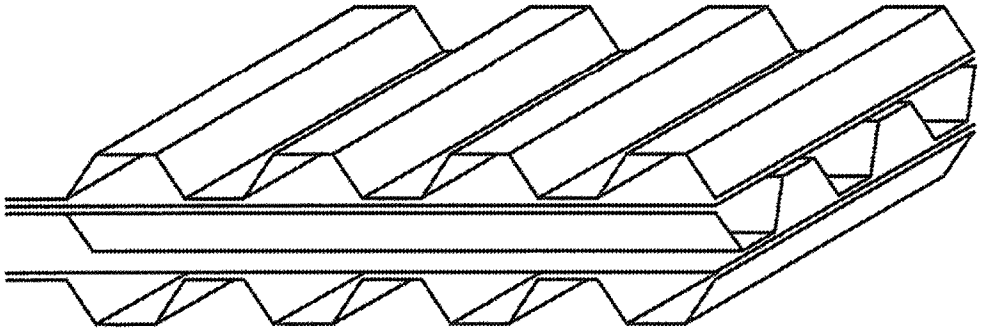

FIG. 20*k* describes a further wall element, which differs from the wall element shown in FIG. 20*j* in that here in addition plane felt layers are arranged between the corrugated felt layers, which stabilize the wall element in that the surfaces available for the connection between the individual layer are increased in this way.

Figure 20L:
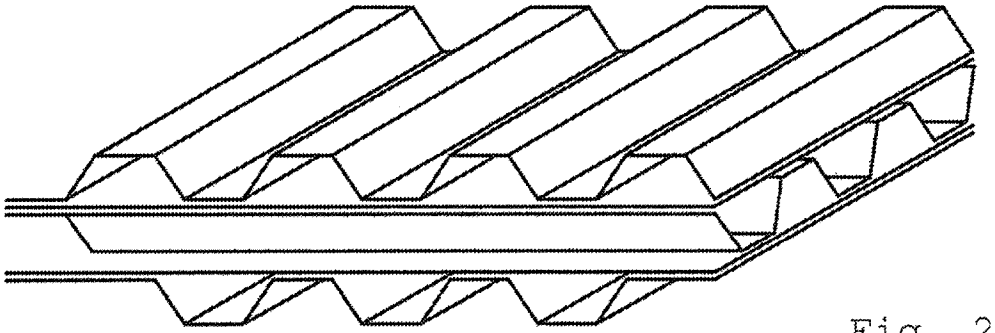

FIG. 20*l* describes a further wall element, which differs from the wall element shown in FIG. 20*k* in that here the upper and the lower corrugated layer are displaced relative to each other similar to the embodiment shown in FIG. 20*g*.

Also in the embodiments which are shown in FIGS. 20*f* to 20*l* it is optional to provide a further stabilization of the wall elements by adding two plane felt layers, which are applied as upper and lower cover layer and are joined to the described structure in the region of the vertex surfaces.

LIST OF REFERENCE SYMBOLS

1 Wall element
2 Felt panel
11, 12 Plane felt layer
21 Corrugated felt layer
21*a* Top side
21*b* Wave peak
21*c* Upper vertex line
21*d* Bottom side
21*e* Wave valley
21*f* Lower vertex line
a Axis
H Cavity
IB1-IB3 Island regions IB1, IB2 and IB3
MS Middle layer
OS Top layer
R Edge region
Ra Edge region (3-sided)
Rb Open edge region
SE Mirror plane arranged SE
S552 Side of 552
S602*a*, S602*b* Side of 602
T Support
TA2*a*, TA2*b* Double-sided pocket of IB2
TA2*c* Single-sided pocket of IB2
TA3*a*, TA3*b* Double-sided pocket of IB3
TA3*c* Single-sided pocket of IB3
U Periphery
US Bottom layer
V Volume region
51 Wall element
52 Felt panel
61, 62 Plane felt layer
71 Corrugated felt layer
101 Wall element
102 Felt panel
111, 112 Plane felt layer
121, 122 Corrugated felt layer
121*f* Lower vertex line
122*c* Upper vertex line
151 Wall element
152 Felt panel
161, 162 Plane felt layer
171, 172 Corrugated felt layer
201 Wall element
202 Felt panel
211-214 Plane felt layer
221, 222, 223 Corrugated felt layer
221*f* Lower vertex line
222*e* Upper vertex line
251 Wall element
252 Felt panel
261-264 Plane felt layer
271-273 Corrugated felt layer
301 Wall element
302 Seventh felt panel
311-316 Plane felt layer
321-325 Corrugated felt layer
351 Wall element
352 Felt panel
361-366 Plane felt layer
371-375 Corrugated felt layer
401 Wall element
402 Felt panel
411 Plane felt layer
451 Wall element
452 Felt panel
501 Wall element
502 Felt panel
511 Plane felt layer
522 Felt panel
551 Wall element
561, 562 Plane felt layer
581 Stand
582, 583 Rod
601 Wall element
602 Felt panel
631, 632 Rod
631*a*, 631*b* End of 631
632*a*, 632*b* End of 632
651 Fourteenth wall element
652 Felt panel

661, 662 Plane felt layer
671, 672 Corrugated felt layer
701 Fifteenth wall element
702 Wall element
711, 712 Plane felt layer
721, 722 Corrugated felt layer
751 Sixteenth wall element
752 Felt panel
761, 762 Plane felt layer
771 Corrugated felt layer
771*c*, 771*f* Upper/lower vertex line

The invention claimed is:

1. A wall element comprising a felt panel having a plurality of felt layers, the layers comprising:

a top flat felt layer having a first planar upper surface and a first planar lower surface, a bottom flat felt layer being spaced away from the top flat felt layer, having a second planar upper surface facing the first planar bottom surface, and a second planar bottom surface, and at least a first corrugated felt middle layer, the at least the first corrugated felt middle layer defining a zig zag pattern having alternating peaks and valleys, each peak including an upper vertex point contacting the first planar lower surface of the top flat felt layer, each valley including a lower vertex point contacting the second planar upper surface of the bottom flat felt layer.

2. The wall element as claimed in claim 1, further comprising at least a second corrugated felt middle layer, the at least the first corrugated felt middle layer and the at least the second corrugated felt middle layer being in contact with each other and oriented in relation to each other such that upper and lower vertex lines defined by aligned upper and lower vertex points, respectively, run in substantially parallel planes and make an angle with each other of at least 20°.

3. The wall element as claimed in claim 2, further comprising an intermediate felt layer provided between the at least the first corrugated felt middle layer and the at least the second corrugated felt middle layer, each of the at least the first and the at least the second corrugated felt middle layers being connected to the intermediate felt layer in a region of the upper vertex lines or the upper vertex points formed by their respective wave peaks and/or in the region of the lower vertex lines or the lower vertex points formed by their respective wave peaks.

4. The wall element as claimed in claim 3, wherein corrugated felt layers which are connected to the same flat felt layer are oriented in such a way to each other that their vertex lines run in parallel planes and stand at an angle to each other of at least 20°.

5. The wall element as claimed in claim 1, wherein the felt panel has a thickness between 10 mm and 50 mm.

6. The wall element as claimed in claim 1, wherein the at least the first corrugated felt middle layer is produced from a flat felt layer with a thickness between 4 mm and 20 mm by a pressing process.

7. The wall element as claimed in claim 1, further comprising cavities formed between the upper vertex points of the at least the first corrugated felt middle layer and between the lower vertex points of the at least the first corrugated felt middle layer.

8. The wall element as claimed in claim 7, wherein the top flat felt layer comprises at least one island region, in which the top and bottom flat felt layers and the at least the first corrugated felt middle layer lie in full-surface and planar manner on each other.

9. The wall element as claimed in claim 8, wherein the island region is configured as an edge region which is closed all around.

10. The wall element as claimed in claim 8, wherein the top flat felt layer has a thickness in a volume region bordering on the at least one island region which is greater than a thickness of the top flat felt layer in the at least one island region, the thicknesses being measured each time orthogonally to the extension of one of the flat felt layers.

11. The wall element as claimed in claim 8, wherein the island region is configured as an edge region, which runs around the top flat felt layer at its periphery only in a segment, or that the island regions are configured as edge regions which run around the top flat felt layer at its periphery spaced apart from each other in several segments.

12. The wall element as claimed in claim 7, wherein the wall element further comprises a support.

13. The wall element as claimed in claim 12, wherein the support comprises a foot and at least one rod, wherein the rod is so adapted to one of the cavities of the top flat felt layer that it can be inserted into the cavity such that the top flat felt layer is carried by the support.

14. The wall element as claimed in claim 12, wherein the support comprises at least one rod, wherein the rod runs through one of the cavities so that it projects on both sides and at an end from the felt panel.

15. The wall element as claimed in claim 1, wherein the felt layers are connected by a connection process making use of an additive and/or by an additive-free connection process.

16. The wall element as claimed in claim 1, wherein the felt panel comprises at least two felt layers and wherein at least one felt layer has a three-dimensional structure on at least one top side, wherein the wall element has one of several point compressions, which are configured such that all of the felt layers lie flat one on another in the region of the point compressions, or a middle region of the point compression, comprises an opening in the form of a notch passing through all of the felt layers, or the at least the first corrugated felt middle layer and an at least a second corrugated felt middle layer are form-fitted together, the two felt layers in neighboring segments being joined with different pressing force so that they have different thicknesses in the neighboring segments, wherein the two felt layers are fashioned as felt layers of trapezoidal cross section and the two felt layers are arranged between a plane top layer and a plane bottom layer and are bonded to it partly in sheetlike manner, or a felt layer of trapezoidal cross section is arranged between the top flat layer and the plane bottom flat layer and are bonded thereto partly in a sheetlike manner, or two felt layers of trapezoidal cross section are bonded partly in a sheetlike manner so that they form cavities running parallel to each other and being hexagonal in cross section, the two felt layers being arranged between the top flat felt layer and the bottom flat felt layer, and are bonded thereto partly in a sheetlike manner, and wherein a flat felt layer is arranged between the felt layers of trapezoidal cross section, dividing the hollow tubes in half, or at least two felt layers of trapezoidal cross section are set off from each other and/or twisted relative to each other and bonded partly in a sheetlike manner to each other, wherein the felt layers of trapezoidal cross section are arranged between the top flat felt layer and the bottom flat felt layer and are bonded to it partly in a sheetlike manner and wherein at least one of the felt layers of trapezoidal cross section has openings, or at least two felt layers of trapezoidal cross section with flat felt layers placed between them are set off from each other and/or twisted relative to each other and bonded partly in a sheetlike manner to the flat felt layers, wherein the felt layers of trapezoidal cross section are arranged between a plane top layer and a plane bottom layer and are bonded to it partly in a sheetlike manner and wherein at least one of the felt layers of trapezoidal cross section has openings.

17. The wall element as claimed in claim 2, wherein the angle is 90°.

18. The wall element as claimed in claim 4, wherein the angle is 90°.

19. The wall element as claimed in claim 5, wherein the thickness is between 20 mm and 40 mm.

20. The wall element as claimed in claim 5, wherein the thickness is around 30 mm.

21. The wall element as claimed in claim 6, wherein the thickness is between 6 mm and 15 mm.

22. The wall element as claimed in claim 6, wherein the thickness is around 8 mm.

23. The wall element as claimed in claim 8, wherein the top and bottom flat felt layers and the at least the first corrugated felt layer are joined together along their entire surfaces.

24. The wall element as claimed in claim 15, wherein the connection process making use of an additive is a gluing process using an adhesive.

25. The wall element as claimed in claim 15, wherein the additive-free connection process is one selected from the group consisting of ultrasound welding and vibration welding.

26. A wall element comprising:

a top flat felt layer having a plurality of substantially parallel upper portions, and a bottom felt layer having a plurality of substantially parallel lower portions, wherein the top felt layer and the bottom felt layer are oriented with respect to one another to define a plurality of substantially parallel generally trapezoidal tubes.

27. A wall element comprising:

a top flat felt layer having a plurality of substantially parallel upper partial portions, a bottom felt layer having a plurality of substantially parallel lower portions, the top felt layer and bottom felt layer being oriented with respect to one another to define a plurality of substantially parallel generally trapezoidal tubes, and a flat felt layer provided between the top felt layer and the bottom felt layer, thereby dividing at least one of the substantially parallel generally trapezoidal tubes into two halves.

* * * * *